United States Patent [19]

Scherbing

[11] 4,228,668

[45] Oct. 21, 1980

[54] AXIAL SPLIT-PIN TUMBLER-TYPE LOCK MECHANISM

[75] Inventor: Frank J. Scherbing, Chicago, Ill.

[73] Assignee: Chicago Lock Co., Chicago, Ill.

[21] Appl. No.: 31,435

[22] Filed: Apr. 19, 1979

[51] Int. Cl.[3] ..... E05B 27/08

[52] U.S. Cl. ..... 70/363; 70/375

[58] Field of Search ..... 70/363, 416, 419, 421, 70/375

[56] References Cited

U.S. PATENT DOCUMENTS

| | | | |
|---|---|---|---|
| 1,998,900 | 4/1935 | Lombardo | 70/363 |
| 3,102,412 | 9/1963 | Christopher | 70/363 |
| 3,267,706 | 8/1966 | Kerr | 70/363 |
| 3,817,066 | 6/1974 | Pearson | 70/363 |
| 3,945,229 | 3/1976 | Frank | 70/363 |
| 4,099,396 | 7/1978 | Kerr | 70/363 |

*Primary Examiner*—Robert L. Wolfe

*Attorney, Agent, or Firm*—Gerlach & O'Brien

[57] ABSTRACT

An axial split-pin tumbler-type lock mechanism having a barrel assembly of a rotatable operating part and a stationary part housed in a lock cylinder, a plurality of tumblers each having a driver element carried by the operating part and a follower element carried by the stationary part, and spring means urging the tumblers into locking positions, includes means providing a plurality of longitudinal grooves in the outer surfaces of the operating and stationary parts, the driver and follower elements being carried in such grooves, and means adjacent to one end of the barrel assembly for seating the spring means.

3 Claims, 7 Drawing Figures

AXIAL SPLIT-PIN TUMBLER-TYPE LOCK MECHANISM

BACKGROUND OF THE INVENTION

This invention relates to axial split-pin tumbler-type lock mechanisms, particularly, to a lock mechanism designed to provide economy in manufacture.

In general, the axial split-pin tumbler-type lock mechanisms include a barrel assembly of a rotatable operating part and a stationary part, and the assembly is housed in a lock cylinder. Tumblers each including a driver element and a follower element are mounted in bores in the parts. The parts adjoin each other at an interfacial plane, the bores meet in alignment at the interfacial plane when the operating part is in a selected rotational position relative to the stationary part, and the tumblers are movable back and forth in the aligned bores. When the interfacial plane is bridged by one or more of the tumbler elements, the operating and stationary parts thereby are secured against rotation relative to each other. When the joints between the tumbler elements coincide with the interfacial plane, upon insertion of the proper key, the operating part may be rotated by means of the key, to accomplish a desired function. U.S. Pat. No. 3,102,412 is illustrative of the lock mechanisms.

The tumbler bores in the prior lock mechanisms of the foregoing type are enclosed within the bodies of the operating and stationary parts, and are formed by drilling solid bodies, or by molding and sintering metal powder. Drilling may result in certain defects or manufacturing disadvantages, caused by drill runout, drill vibration, and chip and burr formation. Additional reaming of the operating and stationary parts in pairs or sets is required, and the parts must be stocked and used in the resulting matched pairs. Elliptical holes may be formed, which decrease pick-resistance. Drill bits break, resulting in lost time. On the other hand, the sintered metal molding method of manufacture is more expensive than the drilling method.

SUMMARY OF THE INVENTION

The present invention provides a lock mechanism of the axial split-pin tumbler-type, having operating and stationary parts which may be manufactured by the least expensive of the available methods of manufacture and with a high degree of accuracy. In particular, the operating and stationary parts may be manufactured by cold-rolling, extruding, and/or broaching, as may be most advantageous.

An axial split-pin tumbler-type lock mechanism to which the invention is directed more specifically includes a lock cylinder having front and rear ends and a substantially smooth cylindrical inner wall surface, the inner wall surface having a longitudinal axis extending in a direction from front to rear in the cylinder, a barrel assembly secured within the cylinder and including a forwardly disposed operating part rotatable about the axis and a rearwardly disposed stationary part, the operating and stationary parts each including a portion having an outer surface adjacent to the inner wall surface and said portions adjoining each other at a transverse interfacial plane, a plurality of tumblers each having a forwardly disposed driver element carried by the operating part and a separate rearwardly disposed follower element carried by the stationary part, the driver and follower elements of respective tumblers being disposed in aligned adjoining relation and each tumbler being longitudinally reciprocally movable relative to the barrel assembly between positions wherein the joint between the elements is disposed respectively on opposite sides of the interfacial plane when the operating part is in a selected rotational position relative to the stationary part, the operating part being free to rotate when the joints coincide with the interfacial plane, the driver elements having front ends engageable with a key which when moved rearwardly moves the tumblers into positions wherein the joints coincide with the interfacial plane, and spring means disposed rearwardly of the follower elements to yieldingly urge the tumblers forwardly to positions wherein the interfacial plane is bridged by the follower elements to secure the operating and stationary parts against relative rotation.

In accordance with the invention, the aforesaid portions of the operating and stationary parts each include means providing a plurality of longitudinal grooves each extending for the full length of the portion in the outer surface thereof and having open opposite ends, the grooves in one portion being aligned respectively with the grooves in the other portion when the operating part is in said selected rotational position, the driver and follower elements being carried in the grooves, and the lock mechanism also includes discrete means disposed rearwardly of said portion of the stationary part for seating the spring means.

In manufacturing the operating and stationary parts, both parts may be severed from one rod, which has been formed with continuous longitudinal grooves therein, such as by cold-rolling, extrusion, and/or broaching methods. It may be preferably to finish the grooves after severing the parts from the rod, such as by broaching the parts after screwmachining them. The finishing operations do not require that the parts be worked on in pairs or sets, and the parts need not be stored or used in matched pairs.

BRIEF DESCRIPTION OF THE DRAWINGS

The attached drawings illustrate a preferred embodiment of the lock mechanism of the invention, without limitation thereto. In the drawings, like elements are identified by like reference symbols in each of the views, and.

DESCRIPTION OF THE PREFERRED EMBODIMENT

Figure 1:
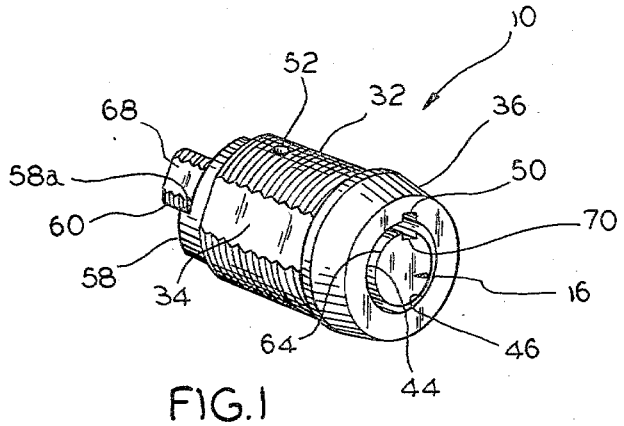
FIG. 1 is a front perspective view of a lock mechanism, in accordance with the invention.

Referring to the drawings, an axial split-pin tumbler-type lock mechanism 10 constitutes a preferred embodiment of the invention. The specific lock mechanism 10 illustrated is employed as part of a "cam lock," shown in its entirety in FIG. 4. The lock mechanism 10 is employed with a tubular key of a conventional type, not illustrated, such as the key illustrated in the above-identified patent. The locking components of the lock mechanism 10, in general, are constructed and function similarly to the corresponding components of prior lock mechanism of the same type, except for the constructional improvements of the invention.

Figure 4:
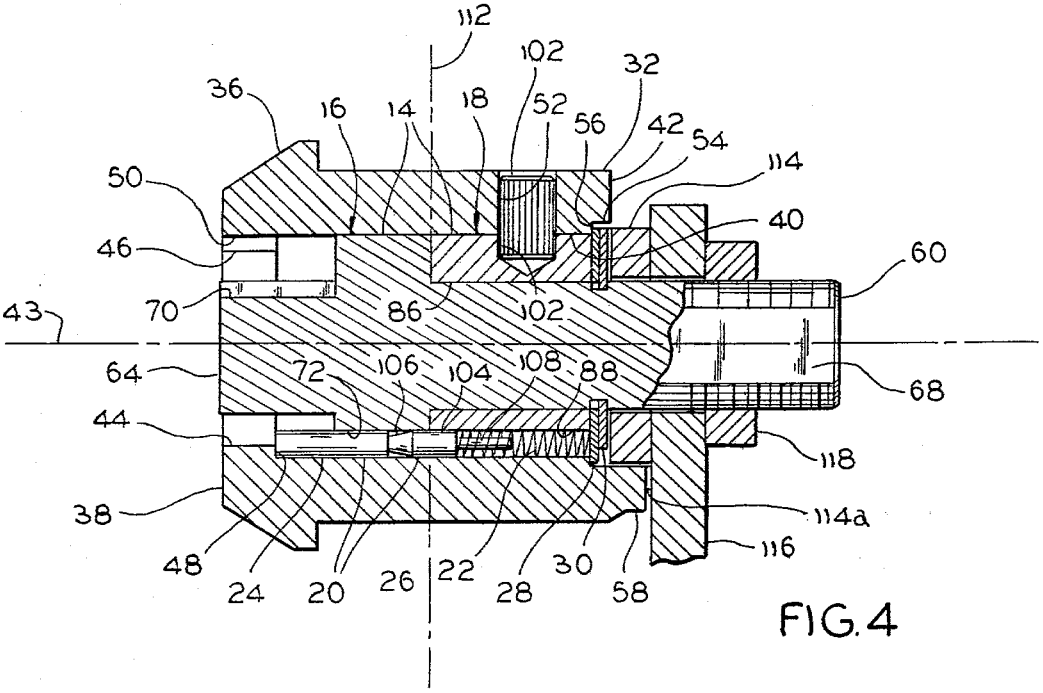
FIG. 4 is an enlarged longitudinal sectional view of the lock mechanism together with additional structure, taken substantially on line 4—4 of FIG. 2, an operating part of the lock mechanism being illustrated partly in section and partly in elevation.

The lock mechanism 10 includes a lock cylinder 12 and a barrel assembly 14 (FIG. 4). The barrel assembly 14 includes a rotatable operating or plug part 16 and a stationary or sleeve part 18. The lock mechanism also includes a plurality of tumblers 20, which are seven in number, and a like number of coil compression tumbler springs 22. Each tumbler 20 is composed of a driver element or pin 24 and a follower or locking element or pin 26. The lock mechanism 10 further includes an annular retaining or backing ring 28 and a split locking ring 30.

The lock cylinder 12 includes an elongated tubular externally threaded body 32 having a pair of flats 34 extending longitudinally on opposite sides thereof, and an enlarged frusto-conical head 36 integral with the body at the front or outer end 38 of the cylinder. The foregoing structure serves for mounting the lock mechanism 10 in a door or wall panel or the like and in a conventional manner. For example, the body 32 may be inserted through a corresponding opening in a panel, and a nut (not shown) may be threaded thereon, for clamping the panel between the nut and the head 36.

Referring to FIG. 4, the lock cylinder 12 has a substantially smooth cylindrical inner wall surface 40 extending forwardly from a location adjacent to the rear end 42 of the body 32. The wall surface 40 has a longitudinal axis 43, which extends in a direction from front to rear in the cylinder 12. An annular closure flange 44 extends radially inwardly from the head 36 at the front end of the lock cylinder 12, and it defines a circular key opening 46. The closure flange 44 forms a rearwardly facing annular tumbler-retention shoulder or ledge 48 extending radially inwardly from the inner wall surface 40 at the front end thereof. A key guide notch or groove 50 extends radially outwardly from the inner edge of the closure flange 44. A radial mounting hole 52 extends through the wall of the cylinder body 32. An annular recess 54 is formed in the rear end 42 of the body, and the recess is bordered by a shoulder 56 extending radially outwardly from the inner wall surface 40. An arcuate longitudinal extension 58 is integral with the rear end 42 of the cylinder body 32, and stop shoulders are formed by the opposite side edges thereof, one of such shoulders being visible in FIGS. 1 and 3 and identified as 58*a*.

Figure 5:
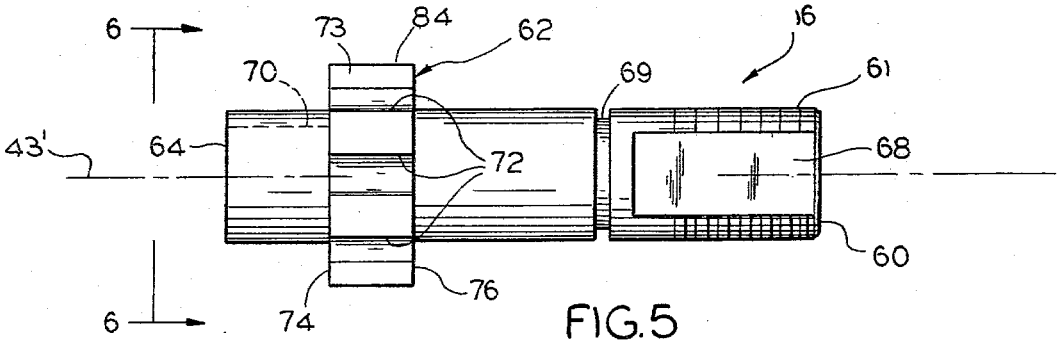
FIG. 5 is a side elevational view of the operating part and FIG. 6 is a front end elevational view thereof, the latter taken on line 6—6 of FIG. 5, both views being on substantially the same scale as FIG. 4.
Figure 7:
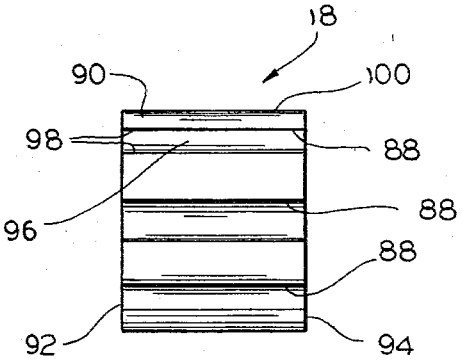
FIG. 7 is a side elevational view of a stationary part in the lock mechanism, on substantially the same scale as FIG. 4.
Figure 6:
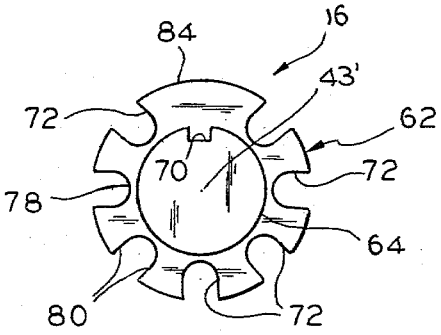

Referring especially to FIGS. 4—6, the components of the operating part 16 include a generally cylindrical lock shaft 60 having a threaded distal end 61, a cylindrically-shaped head 62 of greater diameter than the shaft, and a cylindrically-shaped guide post 64. The operating post 16 has a longitudinal axis 43' in common with its several components, which axis coincides with the longitudinal axes of the complete barrel assembly 14 and the stationary part 18 and with the axis 43 of the inner wall surface 40 when the lock mechanism 10 is assembled. The operating part 16 is illustrated as constructed integrally of the aforesaid components; however, any of the components may be separately constructed and secured to the remaining components, by suitable means. In particular, it is advantageous frequently to construct the guide post 64 separately of harder material.

The lock shaft 60 is provided with a pair of diametrically-opposed flats 68 at the rear end of the shaft. A circumferential transverse groove 69 is formed in the lock shaft 60, intermediate its ends. A longitudinal drive notch or groove 70 is provided in the guide post 64.

A plurality of substantially identical longitudinal grooves 72, seven in number, are formed in the cylindrically shaped outer or peripheral surface 73 of the operating part head 62. Each of the grooves 72 extends for the full length of the head 62, between transverse front and rear surfaces 74 and 76 thereof, and has open opposite ends at such surfaces. Each groove is bounded by a longitudinally extending, substantially semi-cylindrical base wall surface 78 and a pair of longitudinally extending, substantially parallel plane side wall surfaces 80. The side wall surfaces 80 extend outwardly from the base wall surface 78 in tangential relation thereto, to the outer surface 73 of the head 62. The axes of the cylinders corresponding to the base wall surfaces 78 are equidistant from the axis 43' of the operating part 16, and they are equiangular disposed about the latter axis at angles of 45°, except for two grooves 72 along opposite sides of an enlarged land 84 therebetween, the axes of which grooves are angularly spaced at 90°. The grooves 72 are equidistantly spaced outwardly from the lock shaft 60, and also from the illustrative guide post 64.

The stationary part 18 is in the form of a cylindrical tubular sleeve having a cylindrical axial bore 86 (FIGS. 3 and 4), in which the lock shaft 60 is journaled. A plurality of substantially identical longitudinal grooves 88, seven in number, are formed in the cylindrically-shaped outer or peripheral surface 90 of the stationary part 18. Each of the grooves 88 extends for the full length of the stationary part, between transverse front and rear surfaces 92 and 94 thereof, and has open ends at such surfaces. The stationary part grooves 88 are substantially identical in configuration to the operating part grooves 72, and, likewise, they are bounded by semi-cylindrical base wall surfaces 96, and by parallel plane side wall surfaces 98 extending tangentially to the base wall surfaces 96 and outwardly therefrom to the stationary part outer surface 90. The grooves 88 of the stationary part 18 are spaced outwardly from the longitudinal axis of the part, and are angularly disposed about the axis, at the same distances and angles as the operating part grooves 72, with respect to the axis 43'. Thus, the stationary part grooves 88 are disposed at angles of 45° to each other, except for two grooves 88 along opposite sides of an enlarged land 100 therebetween, which are spaced apart at an angle of 90°. A radially extending cylindrical pin-receiving recess 102 (FIG. 4) is provided in the enlarged land 100 of the stationary part 18, and it extends inwardly from the outer surface 90 of the part.

The stationary part 18 is received on the operating part 16, with the lock shaft 60 inserted through the stationary part bore 86, the front surface 92 of the stationary part disposed adjacent to the rear surface 76 of the operating part head 62, and the distal end of the shaft 60 extending rearwardly from the rear surface 94 of the stationary part. The parts of the resulting barrel assembly 14 are secured together by the retaining ring 28 and the locking ring 30, so that the operating part 16 is rotatable relative to the stationary part 18. The retaining ring 28 resembles a flat washer, and it extends radially outwardly from the lock shaft 60 therearound, in contact with the rear surface 94 of the stationary part 18. The retaining ring 28 extends completely across the ends of the stationary part grooves 88 at the rear surface 94, to cover and close the groove ends. The locking ring 30 is in the form of a resiliently expansible split ring, sometimes referred to as an "E-ring," which is removably received in the lock shaft groove 69. The locking ring 30 provides backing support for the retaining ring 28.

Figure 3:
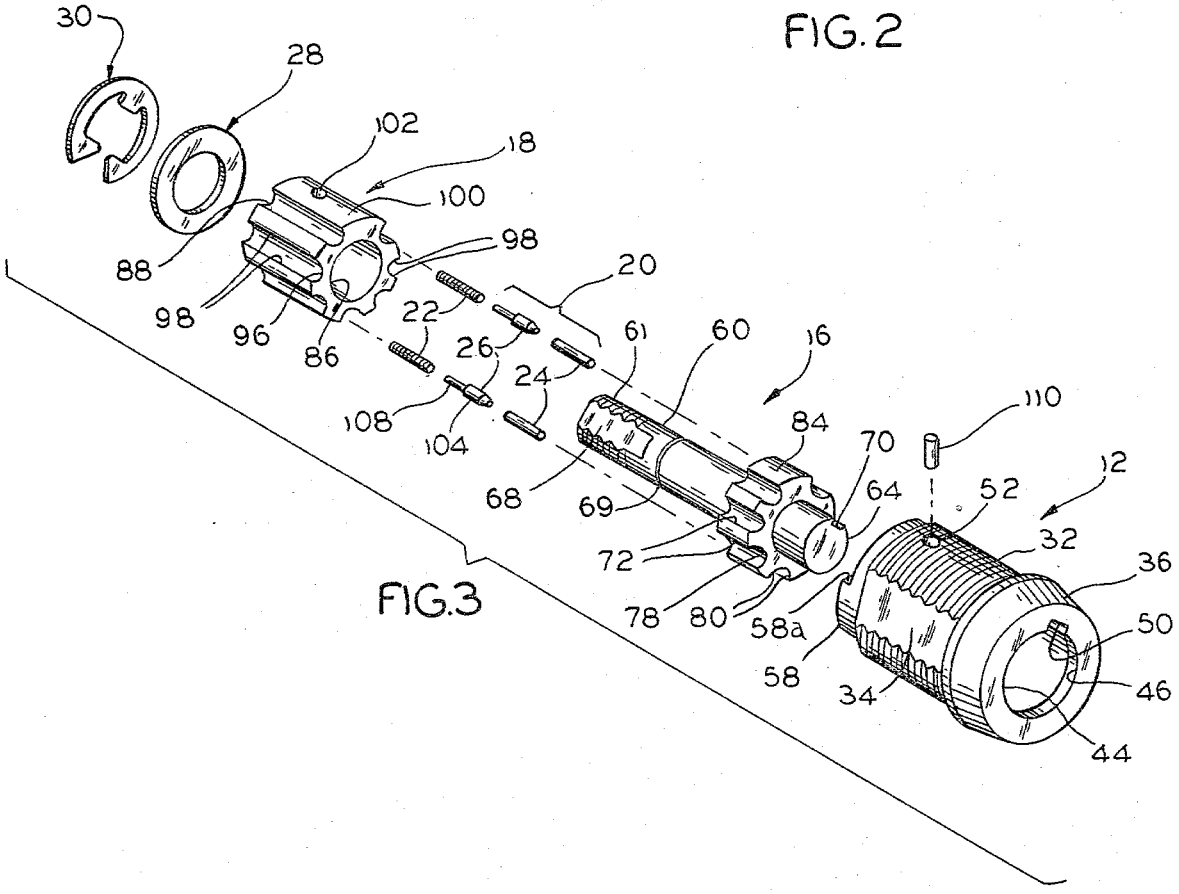
FIG. 3 is an exploded perspective view of the lock mechanism, illustrating but two of the tumblers thereof.

Referring to FIGS. 3 and 4, the driver element 24 of each tumbler 20 in the illustrative embodiment is in the form of a substantially cylindrical pin. The follower element 26 of each tumbler 20 in the illustrative embodiment includes a substantially cylindrical body 104, a frusto-conical head 106, and a rearwardly extending reduced diameter cylindrical stem 108. The driver elements 24 are carried by the operating part 16, in the grooves 72 thereof, and the follower elements 26 are carried by the stationary part 18, in the grooves 88 thereof. The tumbler springs 22 are carried in the stationary part grooves 88. The several driver elements 24 and the several follower elements 26 are constructed in different lengths, in known manner.

The diameter of each driver element 24 and the diameter of the body 104 of each follower element 26 are substantially the same, and the diameters are slightly less than the diameters of the base wall surfaces 78 and 96, and the distances between the pairs of side wall surfaces 80 and 98, which define the operating part and stationary part grooves 72 and 88, respectively. Consequently, the driver and follower elements 24 and 26 may be inserted and removed from the grooves 72 and 88 either from their ends or from their sides, and the elements when in the grooves are longitudinally reciprocally movable therein. A tumbler spring 22 in each stationary part groove 88 is seated on the retaining ring 28, and the spring receives the stem 108 of a follower element 26, which is inserted in its front end.

The diameters of the outer surfaces 73 and 90 of the operating part head 62 and the stationary part 18, respectively, are substantially identical, and slightly less than the diameter of the inner wall surface 40 of the lock cylinder 12. As seen in FIG. 4, the barrel assembly 14 is received in the lock cylinder 12, and the retaining ring 28 and the locking ring 30 are received in the recess 54 therein, with the outer surfaces 73 and 90 of the respective operating and stationary parts 16 and 18 closely adjacent to the inner wall surface 40 and the retaining ring 28 abutting against the shoulder 56 around the recess 54. The retaining ring 28 thus serves to locate the barrel assembly 14, for insertion of a generally cylindrical mounting pin 110 into the aligned mounting hole 52 and pin-receiving recess 102, thereby to secure the barrel assembly 14 to the lock cylinder 12 in desired relative positions. The guide post 64 is centrally disposed in the key opening 46 and is equidistantly spaced from the closure flange 44 therearound, to provide an annular keyway between the post and the flange. The guide post 64 terminates at its front end adjacent to the plane of the face of the closure flange 44.

The depth of each longitudinal groove 72 and 88 in the operating and stationary parts 16 and 18 is but slightly greater than the diameter of a driver element 24 and the diameter of the body 104 of a follower element 26, measuring the groove depth along a line extending radially from the axis 43 through the center of a groove. Consequently, the tumblers 20 are closely enclosed by the inner wall surface 40 of the lock cylinder 12, while free to move longitudinally and to turn in the grooves 72 and 88. The tumbler elements 24 and 26 are supported by the lock cylinder 12 and by the operating and stationary parts 16 and 18 in substantially parallel relation to the axis 43.

The operating post 16 is rotatable in the lock cylinder 12 about the axis 43. In the rotational position illustrated in FIG. 4, representing the initial, locking condition of the lock mechanism 10, the operating part grooves 72 are aligned with respective stationary part grooves 88, the enlarged lands 84 and 100 are in alignment, and the driver and follower elements 24 and 26 of respective tumblers 20 are disposed in aligned adjoining relation. The follower element 26 of each tumbler 20 normally extends from within a stationary part groove 88 into the aligned operating part groove 72, under the pressure of a spring 22. The driver element 24 of the tumbler 20 in part is received within the operating part groove 72 and in part projects forwardly from the front surface 74 of the head 62, into abutting engagement of the front or outer end of the driver element with the retention shoulder 48. The tumblers 20 are longitudinally reciprocally movable relative to the barrel assembly 14, between positions wherein the joint between the tumbler elements 24 and 26 is disposed respectively on opposite sides of a transverse interfacial plane 112 at which the operating part head 62 and the stationary part 18 adjoin. In the initial position of FIG. 4, the tumblers 20 are in outermost positions, wherein the tumbler joints are disposed forwardly of the plane 112. The tumblers 20 may be moved rearwardly to innermost positions, not illustrated, wherein the tumbler joints are disposed rearwardly of the plane 112. The operating part 16 and the stationary part 18 are secured against rotation relative to each other when at least one of the tumbler elements 24 and 26 bridges the plane 112, as illustrated in FIG. 4. The operating and stationary parts 24 and 26 are rotatable relative to each other when all of the tumbler joints coincide with the plane 112.

Figure 2:
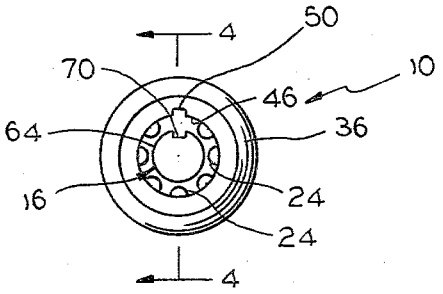
FIG. 2 is a front end elevational view of the lock mechanism.

As illustrated in FIG. 2, a portion of the front end of each driver element 24 is accessible through the key opening 46, for engagement with a conventional tubular key having bittings therearound corresponding in number to the number of tumblers 20. The bittings are provided in various depths, corresponding to the lengths of the driver elements 24, in known manner. Upon insertion of the key through the opening 46, as oriented by a suitable guide lug on the key, which enters the guide notch 50 in the flange 44, the tumblers may be moved rearwardly by rearward movement of the key, until the tumbler joints coincide with the interfacial plane 112, to free the operating part 16 for rotation. A drive lug is provided on the key and is received in the drive notch 70 in the guide post 64, so that the operating part 16 may be rotated by turning the key. The foregoing operation of the lock is illustrated and described in the above-identified patent, among others.

The retaining ring 28 on which the tumbler springs 22 seat serves to assimilate the reaction force of the springs, which urge or bias the tumblers 20 forwardly in the lock mechanism 10. While in certain of the prior lock mechanisms having operating and stationary parts, this function is performed by an integral rear portion of a stationary part, the longitudinal grooves 88 in the herein-described stationary part 18 extend in the outer surface 90 of the stationary part 18 for the full length of the part, to effect economies in manufacture while accurately producing the stationary and operating parts, as described above. The retaining ring 28 and the locking ring 39 replace the prior integral spring-seating structure and perform the function thereof. Also, by employing a suitable type of locking ring and mounting therefor, such as described in the above-identified patent, the tumblers 20 and the tumbler springs 22 may be loaded into and removed from the rear of the assembled lock cylinder 12 and barrel assembly 14, with the retaining ring 28 and the locking ring removed.

The cam lock illustrated in FIG. 4 includes a stop disc 114 and a locking plate or arm 116 mounted on the distal end 61 of the lock shaft 60, for rotation of the stop disc and locking plate with the shaft. The disc and plate are secured in place by a nut 118 in threaded engagement with the lock shaft. The stop disc 114 includes a circumferentially spaced pair of shoulders, one such shoulder 114*a* being partly visible in FIG. 4. The one shoulder 114*a* abuts on one stop shoulder 58*a* (FIG. 1) provided by the extension 58. The remaining disc shoulder abuts on the remaining stop shoulder of the extension 58, upon clockwise (as viewed in FIG. 2) rotation of the operating part 16 through an angle of 90°. In the illustrative embodiment, insertion of a suitable key into the lock mechanism 10 and such rotation of the operating part 16 by the key rotates the locking plate 116 from a locking position, in which it engages a panel or other member, to an unlocking position, in which it is clear of such member. The foregoing additional structure providing a cam lock with the lock mechanism 10 and the operation thereof are conventional. Alternatively, the lock mechanism 10 or a suitably modified structure may be used in conventional ways for other purposes, such as for the operation of electrical switch components.

While a preferred embodiment of the invention has been illustrated and described, it will be apparent to those skilled in the art that the invention is similarly applicable to other lock mechanisms, for example, mechanisms having additional barrel assembly parts or the like, and mechanisms having one or more additional elements in each tumbler. It will be apparent also that other applications may be made, and further changes and modifications may be made, within the spirit and scope of the invention. It is intended that all such applications, changes, and modifications be included within the scope of the appended claims.

I claim:

1. In an axial split-pin tumbler-type lock mechanism including a lock cylinder having front an rear ends and a substantially smooth cylindrical inner wall surface, said inner wall surface having a longitudinal axis extending in a direction from front to rear in the cylinder, a barrel assembly secured within said cylinder and including a forwardly disposed operating part rotatable about said axis and a rearwardly disposed stationary part, said operating and stationary parts each including a portion having an outer surface adjacent to said inner wall surface and said portions adjoining each other at a transverse interfacial plane, a plurality of tumblers each having a forwardly disposed driver element carried by said operating part and a separate rearwardly disposed follower element carried by said stationary part, said driver and follower elements of respective tumblers being disposed in aligned adjoining relation and each tumbler being longitudinally reciprocally movable relative to said barrel assembly between positions wherein the joint between said elements is disposed respectively on opposite sides of said interfacial plane when the operating part is in a selected rotational position relative to the stationary part, said operating part being free to rotate when said joints coincide with said interfacial plane, said driver elements having front ends engageable with a key which when moved rearwardly moves said tumblers into positions wherein said joints coincide with said interfacial plane, and spring means disposed rearwardly of said follower elements to yieldingly urge said tumblers forwardly to positions wherein said interfacial plane is bridged by the follower elements to secure the operating and stationary parts against relative rotation, the improvement wherein said portions of said operating and stationary parts each include means providing a plurality of longitudinal grooves each extending for the full length of the portion in the outer surface thereof and having open opposite ends, said grooves in one portion being aligned respectively with said grooves in the other portion when the operating part is in said selected rotational position, said driver and follower elements being carried in said grooves, and the lock mechanism also includes discrete means disposed rearwardly of said portion of the stationary part for seating said spring means.

2. A lock mechanism as defined in claim 1 and wherein said seating means comprises a retaining ring supported on said operating part adjacent to the rear end of said portion of the stationary part and extending transversely across the rear ends of said grooves in the latter portion.

3. A lock mechanism as defined in claim 1 and wherein said operating part also includes a reduced diameter shaft extending coaxially rearwardly from said portion thereof, said stationary part portion comprises a tubular sleeve having said grooves of the portion therein, said shaft is journaled in said sleeve with a transverse front surface of the sleeve disposed adjacent to a transverse rear surface of the operating part portion and the distal end of the shaft extending rearwardly from a transverse rear surface of the sleeve, and said seating means comprises a retaining ring supported on said shaft adjacent to the rear surface of the sleeve and extending transversely across the rear ends of said grooves in the sleeve.

* * * * *